US007207416B1

(12) United States Patent
Parker

(10) Patent No.: US 7,207,416 B1
(45) Date of Patent: Apr. 24, 2007

(54) REINFORCEMENT PAD FOR PROTECTING A SWIMMING POOL LINER FROM BECOMING DAMAGED BY A SWIMMING POOL LADDER

(76) Inventor: James Parker, 1210 N. West Avenue, Vineland, NJ (US) 08360

( * ) Notice: Subject to any disclaimer, the term of this patent is extended or adjusted under 35 U.S.C. 154(b) by 200 days.

(21) Appl. No.: 11/113,946

(22) Filed: Apr. 25, 2005

Related U.S. Application Data

(63) Continuation-in-part of application No. 10/339,895, filed on Jan. 10, 2003, now abandoned.

(51) Int. Cl.
*E06C 7/42* (2006.01)
*A62B 1/20* (2006.01)

(52) U.S. Cl. ..... 182/193; 182/108

(58) Field of Classification Search ..... 182/194, 182/93, 108, 106, 107, 230; 4/496, 503, 4/506, 498, 504, 502, 456; 240/210; D25/68, D25/69

See application file for complete search history.

(56) References Cited

U.S. PATENT DOCUMENTS 3,023,832 A * 3/1962 Silverman ..... 182/93
3,090,465 A * 5/1963 Smith ..... 182/52
3,420,558 A * 1/1969 Whitten, Jr. ..... 403/24
4,603,758 A * 8/1986 Pettit ..... 182/194
4,716,987 A * 1/1988 Lindberg, Jr. ..... 182/97
5,242,029 A * 9/1993 Marcella ..... 182/82

* cited by examiner

*Primary Examiner*—Hugh B. Thompson, II
(74) *Attorney, Agent, or Firm*—Goldstein Law Offices PC

(57) ABSTRACT

A reinforcement pad for protecting a liner of a pool from damage caused by a user ascending and descending a pool ladder having two upper ends and two lower ends. The reinforcement pad has a substantially oval pad base and a substantially cylindrical socket extending therefrom. The socket, which has a centrally located bore, is mateable with only one lower ladder end. A user inserts one lower ladder end into the bore of the socket of one reinforcement pad. The user then repeats this step with the other lower ladder end and another reinforcement pad. Next, the user positions the pad base against the pool liner and attaches the upper ladder ends to the pool deck. The pad distributes pressure applied to the ladder over the wider area of the lower surface of the pad base, thereby preventing the liner from becoming damaged.

6 Claims, 3 Drawing Sheets

REINFORCEMENT PAD FOR PROTECTING A SWIMMING POOL LINER FROM BECOMING DAMAGED BY A SWIMMING POOL LADDER

CROSS-REFERENCES AND RELATED SUBJECT MATTER

This application is a continuation-in-part of utility patent application Ser. No. 10/339,895, filed in the United States Patent and Trademark Office on Jan. 10, 2003 now abandoned.

BACKGROUND OF THE INVENTION

1. Field of the Invention

The invention relates to a reinforcement pad for protecting swimming pool liners from becoming damaged by swimming pool ladders.

2. Description of the Related Art

Millions of American homes have swimming pools which provide users with recreation and exercise. Although there are many benefits which derive from owning a swimming pool, there are also a number of problems related to the upkeep and maintenance of a swimming pool. In particular, the vinyl pool liners which are attached to the side walls of a swimming pool must be kept intact, in order to prevent water from leaking from the swimming pool. Although pool liners are typically sturdy, they can be damaged in a variety of ways. Pool liners are expensive and replacing the pool liner can cost thousands of dollars. A significant amount of the damage to pool liners occurs where the pool ladder contacts the pool liner. Use of the pool ladder by individuals entering or exiting the pool exerts tremendous pressure at the area of contact between the pool ladder and the pool liner. Accordingly, there is a need for a reinforcement pad which may be placed between the pool ladder and the pool liner in order to protect the pool liner from becoming damaged by repeated use of the pool ladder.

A variety of swimming pool accessories are available which relate to swimming pool liners. U.S. Pat. No. 4,847,926 to Laputaka appears to show a liner retaining bracket for attaching a pool liner to the upper edge of a retaining wall of a pool, for enhancing structural integrity.

U.S. Pat. No. 5,953,867 to Colletto appears to show a seal arrangement for a swimming pool lining structure for protection of the walls and bottom of a pool. U.S. Pat. No. 6,209,151 to Schwimmer appears to show a flexible liner for a pool which is attached to the upper edge of a pool.

None of these devices, however, appears to show a reinforcement pad for protection of a pool liner from damage caused by use of a pool ladder. While these units may be suitable for the particular purpose employed, or for general use, they would not be as suitable for the purposes of the present invention as disclosed hereafter.

SUMMARY OF THE INVENTION

It is an object of the invention to provide a reinforcement pad which can be effectively employed with pool ladders of widely varying dimensions. Accordingly, a socket of the reinforcement pad can receive only one lower end of the ladder.

It is another object of the invention to provide a reinforcement pad which protects a pool liner from damage caused by repeated use of the pool ladder. Accordingly, the reinforcement pad has a pad base with a large surface area, and thereby distributes the pressure exerted by the pool ladder at the junction between the ladder and the lining over a larger area, and thereby prevents rupturing the pool liner by use of the ladder.

It is yet another object of the invention to provide a reinforcement pad which may be used with virtually any pool. Accordingly, the reinforcement pad may be installed when a new pool is constructed or it may be appended to an existing pool.

It is yet another object of the invention to provide a reinforcement pad which is not unduly expensive. Accordingly, the reinforcement pad is constructed from inexpensive plastic and its cost is not prohibitive.

The invention is a reinforcement pad for protecting a liner of a pool from damage caused by a user ascending and descending a pool ladder having two upper ends and two lower ends. The reinforcement pad has a substantially oval pad base and a substantially cylindrical socket extending therefrom. The socket, which has a centrally located bore, is mateable with only one lower ladder end. A user inserts one lower ladder end into the bore of the socket of one reinforcement pad. The user then repeats this step with the other lower ladder end and another reinforcement pad. Next, the user positions the pad base against the pool liner and attaches the upper ladder ends to the pool deck. The pad distributes pressure applied to the ladder over the wider area of the lower surface of the pad base, thereby preventing the liner from becoming damaged.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1A:
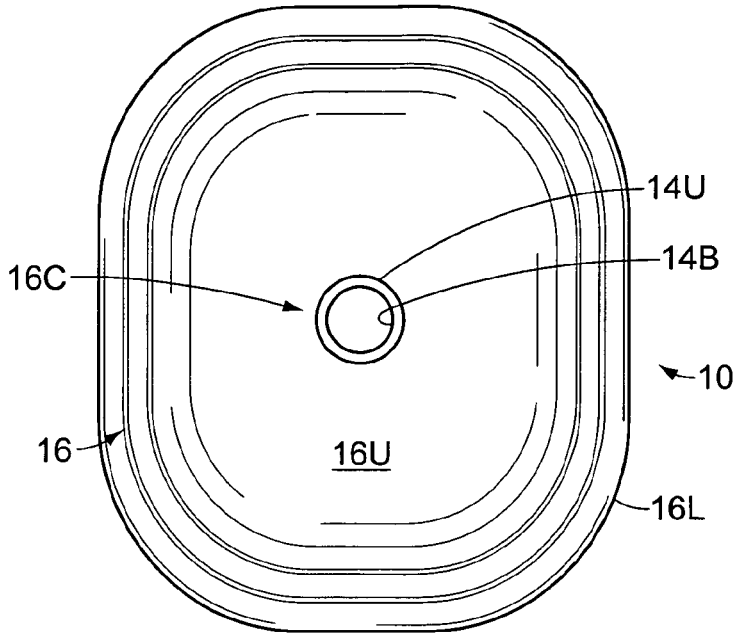
FIG. 1A is a front elevational view of the reinforcement pad.

FIG. 1A illustrates a front elevational view of the reinforcement pad 10 comprising a pad base 16 and one substantially cylindrical socket 14. The pad base 16 has a substantially oval upper surface 16U and lower surface 16L, and a central portion 16C. The pad base 16 also has a side portion 16S which may be seen in FIG. 2. The socket 14 has a lower surface which is attached to the upper surface 16U of the pad base 16, and an upper surface 14U having a centrally located bore 14B. The socket 14 extends outward from the central portion 16C of the upper surface 16U of the pad base 16. The upper surface 16U of the pad base 16, the upper surface 14U of the socket 14, and the bore 14B, are visible in FIG. 1A.

Figure 1B:
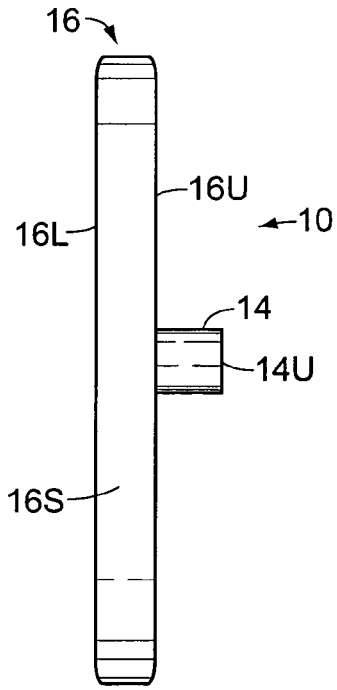
FIG. 1B is a side view of the reinforcement pad.

FIG. 1B illustrates a side view of the pad 10, wherein the side portion 16S of the pad base 16 may be seen. The socket 14 extends from the upper surface 16U of the pad base 16.

Figure 2:
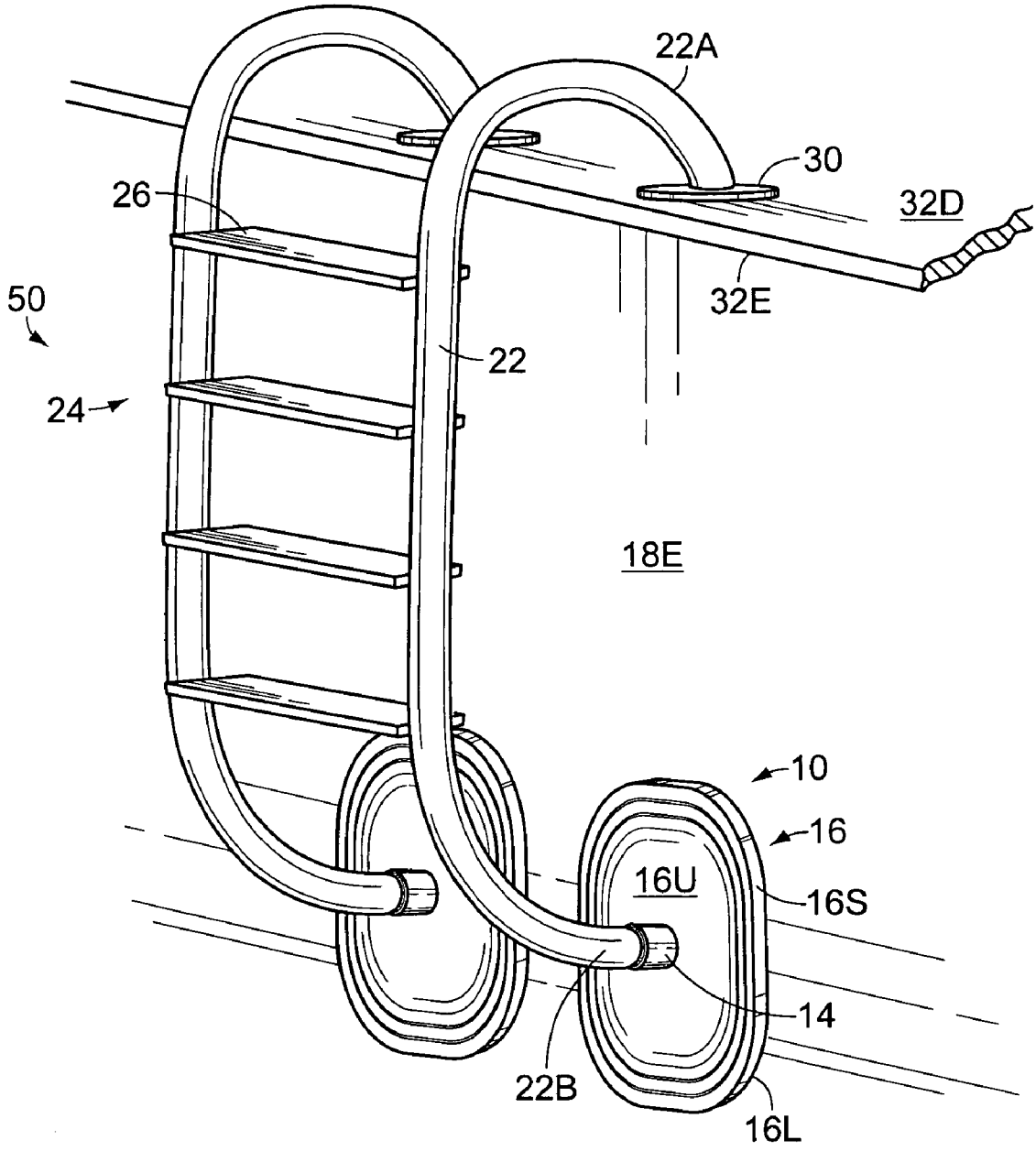
FIG. 2 is a perspective view of two reinforcement pads being used to protect the liner of a swimming pool from damage caused by a pool ladder.

The reinforcement pad 10 is specifically designed to be utilized with pool ladders only. Any attempt to use the pad 10 with other devices would be futile. FIG. 2 illustrates the pad 10 being used in conjunction with a typical pool ladder 24 in a pool 50. In particular, the pad 10 is positioned between the ladder 24 and the liner 18. The pool 50 is defined by a pool edge 32E. The pool edge 32E is surrounded by a pool deck 32D. The pool 50 has a side wall 32 which is covered by the pool liner 18 and which is therefore not visible. In FIG. 2, the external surface 18E of the pool liner 18 is visible. The pool ladder 24 has two vertical bars 22 and a plurality of horizontal steps 26 by which a user may ascend or descend the ladder 24. The steps 26 each extend between the two vertical bars 22 and are evenly spaced along the vertical bars 22. Each vertical bar 22 has an upper end 22A which is attached to the pool deck 32D by a mounting pad 30, and a lower end 22B which connects to the upper surface 14U of the socket 14.

As seen in FIG. 2, each lower end 22B of the ladder 24 extends inside the bore 14B of the socket 14 of a different pad 10. Accordingly, the pad 10 can be effectively employed with pool ladders of all types, including those having widely varying heights, widths and step configurations. This versatility of the pad 10 is an essential aspect of the present invention. In this regard, use of the pad 10 is in no way limited to use with a ladder of the type represented by reference numeral 24, which is illustrative only. The pad 10 may employ stainless steel mounting screws for secure attachment of the lower ends 22B of the vertical bars 22 to the upper surfaces 14U of the sockets 14. When the ladder 24 is used by individuals to enter or leave the pool 32, the pressure exerted by the lower ends 22B of the vertical bars 22 onto the pool liner 18 is first exerted onto the sockets 14 and then onto the underlying pad bases 16. Because of the wide surface area of the lower surface 16L of each pad base 16, the pressure exerted by the lower ends 22B of the vertical bars 22 is distributed over a wider area of the pool liner 18, thereby preventing damage to the pool liner 18.

Figure 3:
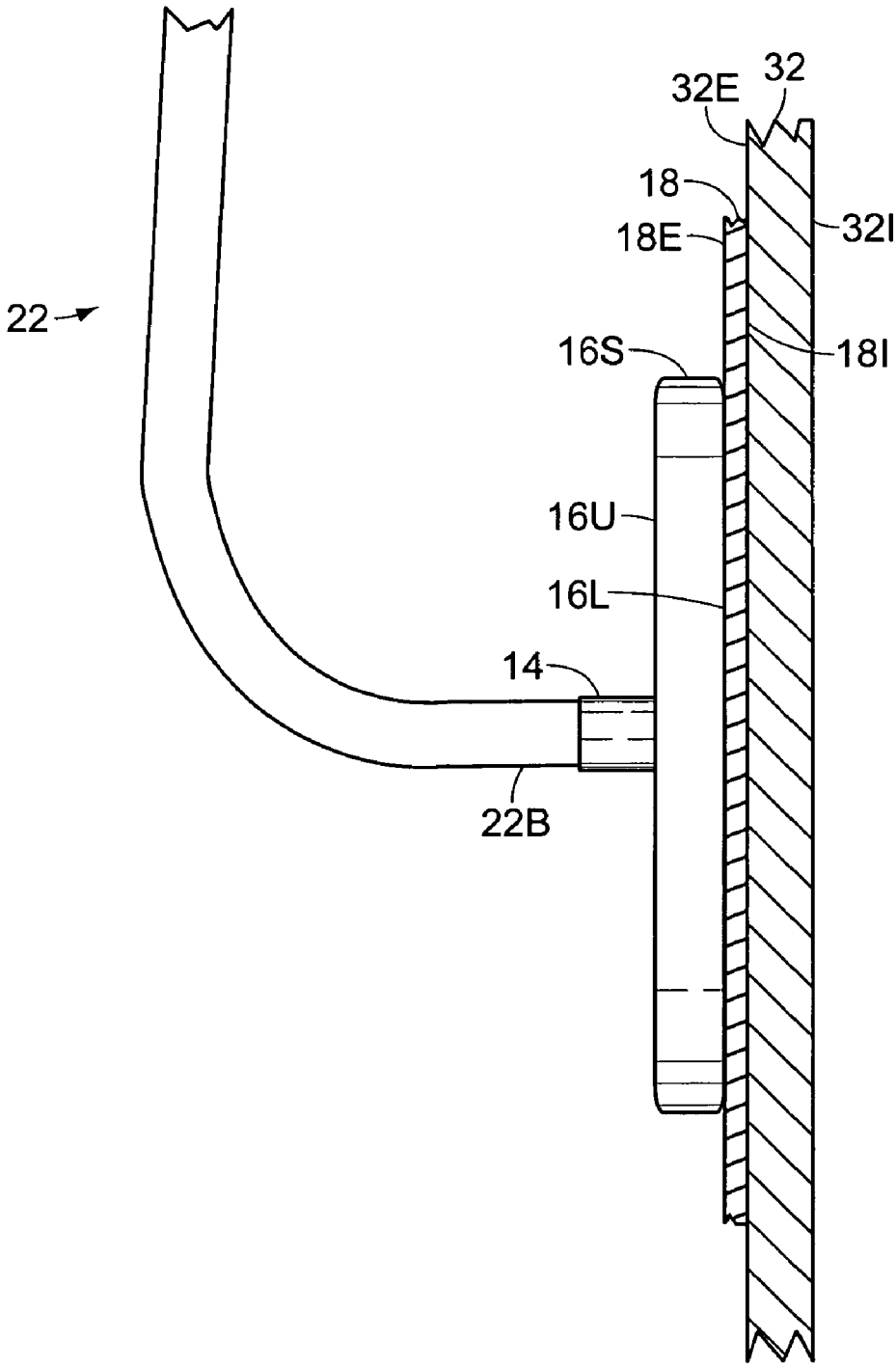
FIG. 3 is a side view of the reinforcement pad being used to protect the liner of a swimming pool from damage caused by a pool ladder.

FIG. 3 illustrates a side view of one reinforcement pad 10 being used to protect the pool liner 18 which covers the side wall 32 of a pool 50. The pool liner 18 has an external surface 18E and an internal surface 18I. The side wall 32 has an externally oriented surface 32E and an internally oriented surface 32I. The internal surface 18I of the liner 18 is in contact with the externally oriented surface 32E of the side wall 32. The lower surface 16L of the pad base 16 is in contact with the external surface 18E of the liner 18. The lower ends 22B of the vertical bars 22 attach to the upper surfaces 14U of the sockets 14. Pressure exerted by the lower ends 22B of the vertical bars 22 on the liner 18 is distributed over the substantially wider area afforded by the lower surface 16L of the base 16.

The reinforcement pads 10 are preferably constructed from a durable plastic. The pad base 16 is available in the oval shape as described above, and additionally, in a substantially square shape. The overall dimensions of the upper surface 16U and the lower surface 16L of the pad base 16 are preferably approximately sixteen inches in length and ten inches in width. Preferably, the width of the side portion 16S of the pad base 16 is approximately ¾ inch.

To employ the pads 10, a user inserts one lower end 22B of the ladder 24 into the bore 14B of the socket 14 of a first pad 10. The user then attaches the second end 22B of the vertical bar 22 to the upper surface 14U of the socket 14 with stainless steel mounting screws provided for this purpose. Next, the user repeats these steps with the other lower end 22B and a second pad 10. The user then positions the lower surface 16L of each pad base 16 against the external surface 18E of the pool liner 18. Next, the user attaches the upper ends 22A of the ladder 24 to the pool deck 32D. The ladder 24 is now safely attached to the pool 50 without fear of subsequent damage to the pool liner 18 caused by use of the ladder 24, because the pad 10 distributes the pressure exerted by the ladder 24 on the pool liner 18 over a wider area of more than one hundred square inches, thereby protecting the liner 18 from damage.

In conclusion, herein is presented a reinforcement pad for protecting a pool liner from damage caused by a pool ladder. The invention is illustrated by example in the drawing figures, and throughout the written description. It should be understood that numerous variations are possible, while adhering to the inventive concept. Such variations are contemplated as being a part of the present invention.

What is claimed is:

1. A reinforcement pad for use in conjunction with a pool, the pool having a pool liner and a pool ladder, the liner having an external liner surface, the ladder having two upper ladder ends and two lower ladder ends, the lower ladder ends being attached to the liner, for protecting the liner from damage caused by a user ascending and descending the ladder, comprising:

a pad base having an upper base surface and a lower base surface, the upper base surface having a central portion, the lower base surface being in contact with the external liner surface when the reinforcement pad is in use; and a substantially cylindrical socket having an upper socket surface and a lower socket surface, the upper socket surface being mateable with only one lower ladder end, the lower socket surface being attached to the upper base surface, wherein the socket extends outward from the central portion of the upper base surface.

2. The reinforcement pad as recited in claim 1, wherein the upper socket surface has a centrally positioned bore for receiving therein the one lower ladder end.

3. The reinforcement pad as recited in claim 2, wherein the lower base surface has an area of substantially one hundred square inches for distributing force applied to the ladder against a significant region of the external liner surface.

4. A method of using a pair of reinforcement pads in a pool, the pool having a side wall, a pool liner, a pool ladder and a pool deck, the liner having an external liner surface, the ladder having two upper ladder ends and two lower ladder ends, the lower ladder ends being attached to the liner, each reinforcement pad having a pad base and a substantially cylindrical socket, the pad base having an upper base surface and a lower base surface, the upper base surface having a central portion, the lower base surface being in contact with the external liner surface, the socket having an upper socket surface and a lower socket surface, the upper socket surface being mateable with only one lower ladder end, the lower socket surface being attached to the upper base surface, the socket extending outwardly from the central portion of the upper base surface, comprising the steps of:

a) mating one lower ladder end with the upper socket surface of one reinforcement pad;

b) mating the other lower ladder end with the upper socket surface of the other reinforcement pad;

c) positioning the lower base surfaces of both reinforcement pads against the external liner surface;

d) attaching both upper ladder ends to the deck; and e) descending the ladder.

5. The method of using a pair of reinforcement pads as recited in claim 4, wherein each upper socket surface has a centrally positioned bore, and wherein the step of mating one lower ladder end with the upper socket surface of one reinforcement pad further comprises inserting one lower ladder end into the bore of one reinforcement pad.

6. The method of using a pair of reinforcement pads as recited in claim 5, wherein the step of mating the other lower ladder end with the upper socket surface of the other reinforcement pad further comprises inserting the other lower ladder end into the bore of the other reinforcement pad.

* * * * *